US006539618B1

(12) United States Patent
Lyke

(10) Patent No.: US 6,539,618 B1
(45) Date of Patent: Apr. 1, 2003

(54) BALL GRID ARRAY TOOL

(75) Inventor: James C. Lyke, Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 0 days.

(21) Appl. No.: 09/580,227

(22) Filed: May 26, 2000

(51) Int. Cl.[7] ..... H01R 43/00

(52) U.S. Cl. ..... 29/762; 29/840; 29/860; 29/611; 29/613

(58) Field of Search ..... 29/762, 764, 758, 29/426.5, 426.6, 825, 840, 860, 611, 613, 270, 278, 283.5, 700

(56) References Cited

U.S. PATENT DOCUMENTS 846,853 A * 3/1907 Howell ..... 219/544
2,777,044 A * 1/1957 Lytle ..... 219/19
3,031,375 A * 4/1962 Jepson ..... 514/174
3,031,735 A * 5/1962 Jepson ..... 29/155.5
3,031,739 A * 5/1962 Boggs ..... 29/155.63
3,117,296 A * 1/1964 Leshem ..... 338/19
3,213,521 A * 10/1965 Owers ..... 29/155.63
3,213,522 A * 10/1965 Bremer ..... 29/155.63
3,221,396 A * 12/1965 Bremer et al. ..... 29/155.5
3,363,307 A * 1/1968 Ulam ..... 299/438
3,468,022 A * 9/1969 Fisher ..... 29/611
3,629,040 A * 12/1971 Hinton et al. ..... 156/275
4,203,198 A * 5/1980 Hackett et al. ..... 219/611
4,950,873 A * 8/1990 Shida et al. ..... 219/548

* cited by examiner

*Primary Examiner*—Timothy V. Eley
*Assistant Examiner*—David Nguyen
(74) *Attorney, Agent, or Firm*—James M. Skorich; Kenneth E. Callahan

(57) ABSTRACT

A tool for removing ball grid array (BGA) packaged integrated circuit or multi-chip modules from printed circuit boards is comprised of a two-tined fork with a heated wire stretched between the tips of the tines and a thin sheet of material filling the area between the tines.

3 Claims, 4 Drawing Sheets

BALL GRID ARRAY TOOL

STATEMENT OF GOVERNMENT INTEREST

The conditions under which this invention was made are such as to entitle the Government of the United States under paragraph 1(*a*) of Executive Order 10096, as represented by the Secretary of the Air Force, to the entire right, title and interest therein, including foreign rights.

BACKGROUND OF THE INVENTION

1. Field of the Invention

This invention pertains to a repair approach in electronics assemblies, and specifically, to a tool for the removal of solder-attached, non-underfilled ball grid array electronic packages from printed wiring boards 2. Description of the Prior Art In electronics, the package contains one or more components. Packages, in a traditional sense, are the "containers" of integrated circuits (ICs) or multi-chip modules (MCMs) that might be soldered onto a printed wiring board. They are limited in physical size, as they must be large enough to be handled by humans, but small enough to mount within other assemblies. The simultaneous growth of signal count and increase in operating frequency of contemporary single chip packages (SCPs) and MCMs demands spatially efficient, adequate, and electrically effective packages, both for test and operation.

Packages can be classified as through-hole or surface mount. Surface mount packages, as the name implies, attach to the surface of a board and do not perforate the board with pins. Recently, the quantity of surface mount packages used in assemblies worldwide exceeded through-hole packages. Ball grid arrays (BGAs) is one of a number of surface mount packages that is becoming increasingly popular. The ball grid array (FIG. 1) is similar to a pin grid array, except that solder balls replace the pins. Rather than penetrate the board with each pin, as in the case of through-hole packages, BGAs are attached by solder reflow action to the surface of a board onto mating land patterns.

The ball grid array (BGA) package may be viewed as the single most important development in packaging this decade. Although BGAs represent a very small percentage of the total package usage today, BGA technology is one of the fastest rising technologies in the advanced packaging field. BGAs have been applied to workstation and computer processors, complex gate arrays, field programmable gate arrays, and consumer and automotive applications.

BGAs can support higher numbers of I/O much more efficiently than perimeter-based packages. BGAs have many other important advantages. As a surface-mount approach, they have improved routability over through-hole approaches of similar complexity since pins do not penetrate the mounting board, thereby occluding valuable routing real estate. Their electrical performance is significantly better than other traditional package types, and BGA packages are smaller and lighter than other package types. They are less fragile than quad flat packages, which have delicate leads that if bent even slightly require special handling for assembly.

One of the most striking advantages of BGAs over other package styles is ease of assembly (notwithstanding the application of underfill) due to the self-alignment property of solder ball arrays. The surface tension of solder acts to bring the array of solder connections into alignment with the mating pattern of contacts on the board onto which a BGA is assembled. As shown in FIG. 2, misalignments (which can be as severe as half the ball diameter) can be corrected as the assembly is heated to the solder reflow temperature point.

By far the most common type of BGA in current use is the plastic ball grid array (PBGA) (FIG. 3). The PBGA involves forming a BGA package from circuit board material, usually BT resin. One side of this board contains a BGA I/O pattern, and the other side accommodates an IC direct chip attachment, usually through wire bonding. In the formation of the BGA, the component is mounted and encapsulated, and the solder balls are then attached in one of several ways, resulting in a finished assembly.

The most significant problem in BGA application is thermal expansion mismatch. In the case of PBGAs, the problem occurs within the package itself In the region of the package where silicon is mounted, the expansion of the board material is constrained relative to its own expansion in silicon-free regions. The differential expansion sometimes creates cracking in solder balls in the boundary between the two regions. Overall package expansion can occur, particular in metal and ceramic BGAs, in which cases the stress is an increasing function of size. Fractures often occur at solder ball interfaces.

Several concepts have emerged to deal with mismatch problems. A more common practice involves the introduction of an underfill, a polymer injected underneath the mounted package, which surrounds the solder balls and creates a much more robust mechanical attachment. It is only with reluctance that assemblers use underfill, though, as most underfill compounds render the associated BGAs non-repairable, and the underfill application process is time-consuming and problematic.

The removal of BGA packages currently involves using a hot air machine with hoses and appropriately shaped nozzles to guide air that is pre-heated to solder-melting temperatures underneath the package. When the hot air is directed adequately with enough duration to melt the solder, it can then be removed with care. The present invention is a compact hand-held tool that simplifies this task. It basically consists of a heated metal wire that is slid through the interface between the BGA packaged IC or MCM and the printed wiring board. A thin Teflon sheet follows the wire to prevent the molten solder from re-solidifying.

SUMMARY OF THE INVENTION

The present invention is an efficient, simple, and economical.tool and method for removing ball grid array packaged integrated circuitry or multi-chip modules from printed circuit boards. The tool consists of a wire stretched between the tips of a two tine fork-shaped instrument and a thin (Teflon) sheet filling the area between the tines. The wire is heated by a constant current source to beyond the melting point of the solder system. The Teflon sheet is used to interrupt the molten solder, which would otherwise have a tendency to collapse onto itself after melting. After the tool is pushed through the entire solder array, the BGA is freed from its attachment and can be easily removed. The tool's use is limited to assemblies that do not have underfill.

BRIEF DESCRIPTION OF THE DRAWINGS

The various features of novelty that characterize the invention are pointed out with particularity in the claims annexed to and forming a part of this disclosure. For a better understanding of the invention, its operating advantages, and specific objects attained by its uses, reference is made to the accompanying drawings and descriptive matter in which a preferred embodiment of the invention is illustrated.

DETAILED DESCRIPTION

Figure 1:
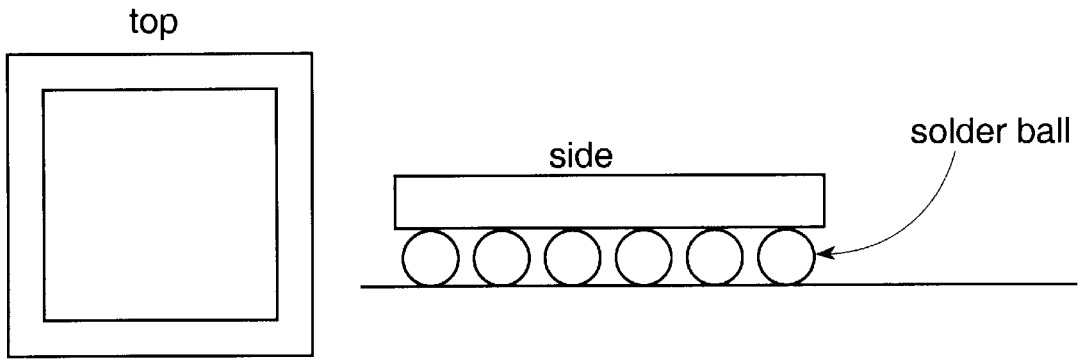
FIG. 1 is a top and side view of a ball grid array.
Figures 2A, 2B, 2C, 2D:
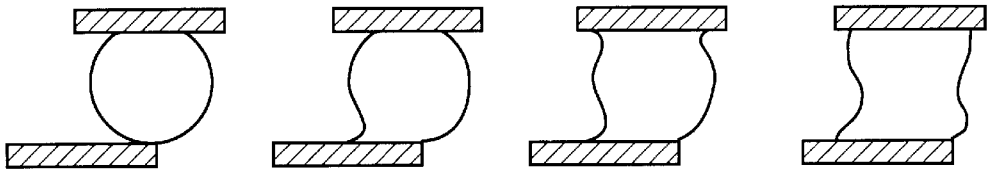
FIG. 2 is a diagram demonstrating the self-aligning property of solder ball arrays.
Figures 2E, 2F, 2G:
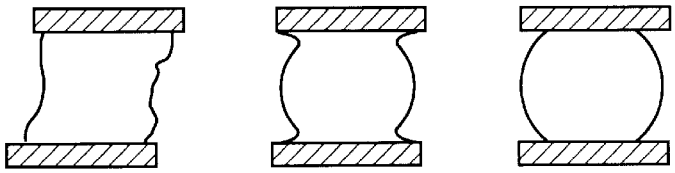
Figure 3:
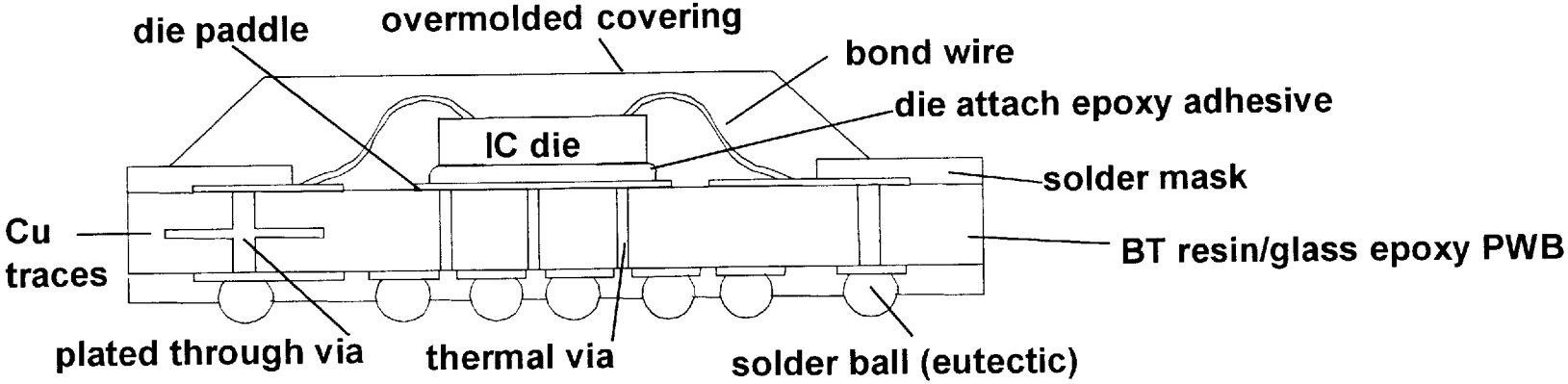
FIG. 3 is a diagram of a typical plastic ball grid array.
Figure 4:
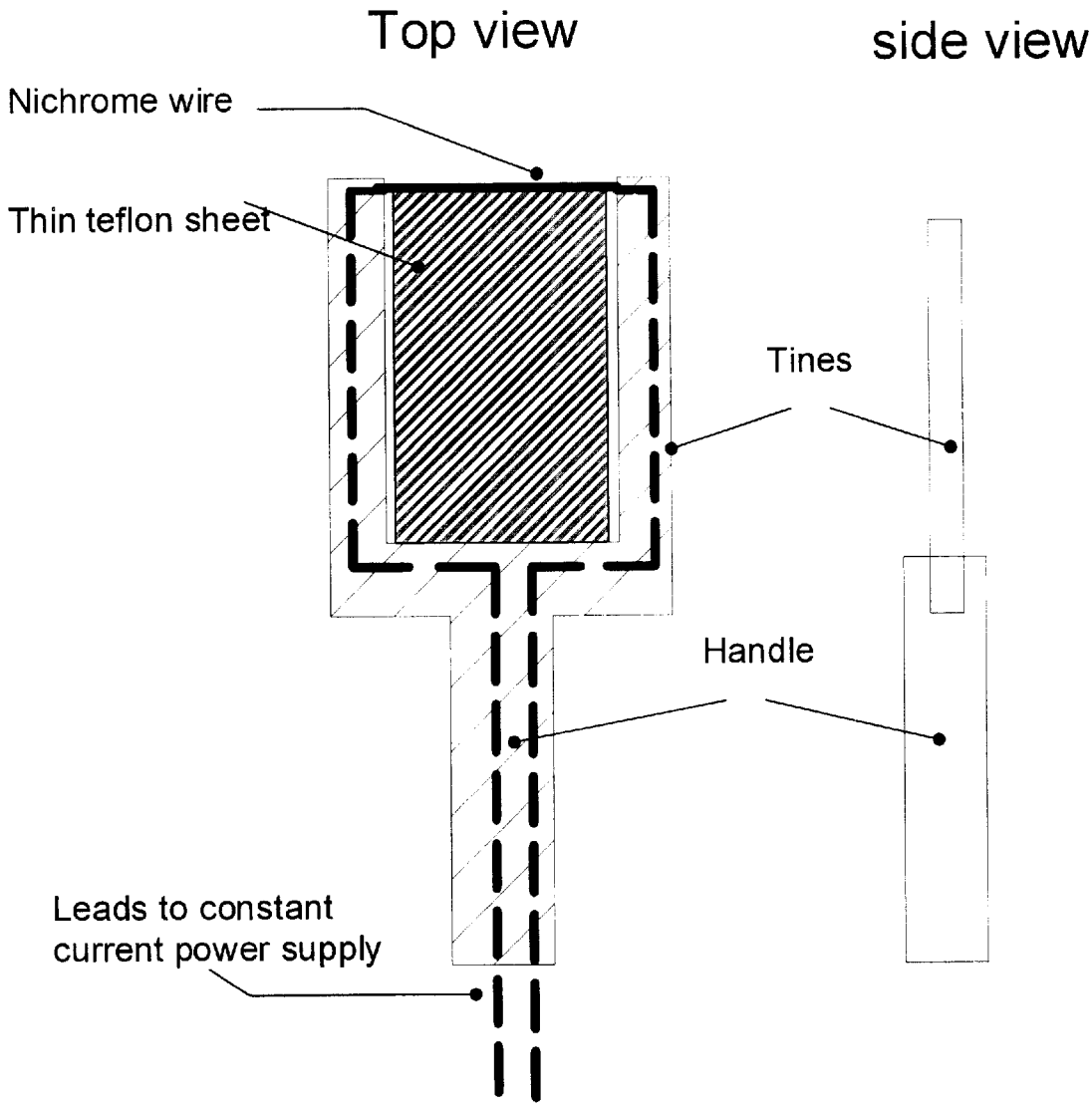
FIG. 4 is a top and side view of the BGA removal tool.
Figure 5A:
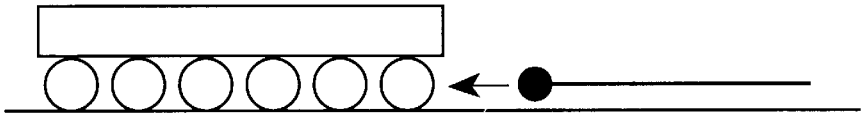
FIG. 5 shows the BGA removal process using the tool.
Figure 5B:
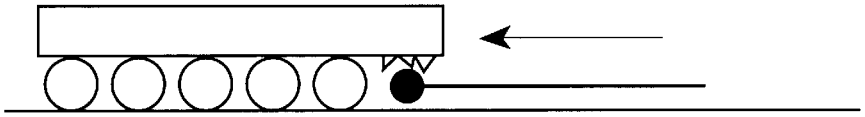
Figure 5C:
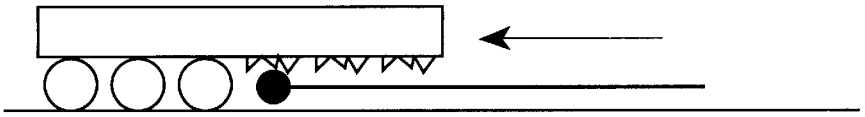
Figure 5D:
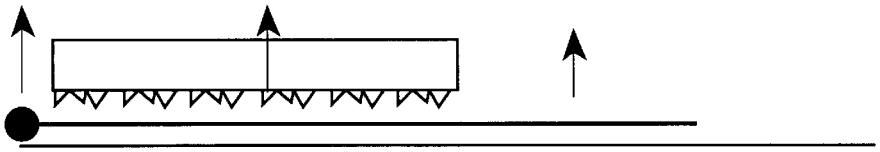

The proposed invention is a hand tool that might look somewhat like a cheese slicer. A simplified embodiment is shown in FIG. 4. This fork-shaped BGA removal tool consists of a handle, two tines (like a tuning fork), a current-carrying wire stretched between the tines (preferably nichrome), a thin (estimated one thousandth inch thick) insulative sheet of (preferably Teflon or other suitable material), a cord with two wires that emanates from the bottom of the handle, and a constant current power supply.

The handle is for holding the tool and need only have sufficient bulk and durability to fulfill that purpose. The tines are attached to it, and it is hollowed out to accommodate the cord.

The tines emanate from either side of the handle when the tool is viewed from the top (the view shown in FIG. 4. They serve the purpose of maintaining tension on the nichrome wire and guiding it as it melts through solder balls in a BGA assembly. They are flat and hollow, each accommodating one wire from the cord, which connects to the nichrome wire. The tines are stiff, but not necessarily rigid, because it may be necessary to slightly bend the tines together so as to make it easier to maneuver the tool to attain better access to a part that is to be removed with the tool. They should allow the nichrome wire to be rapidly serviced (replaced).

The nichrome wire (or other suitable material) connects on each end to the cord and is used to melt the solder balls of a BGA assembly. The wire diameter is to be chosen carefully. It must be large enough to withstand the stresses of being pushed through a matrix of solder balls and not break if caught on the underside of the package during use. It must also be small enough to actually be worked underneath the package. It may be necessary to accommodate different sizes of wires, since BGAs and chip scale packages will have different ball diameters.

The Teflon sheet fills the loop formed by the tines. handle, and wire. The sheet is closely placed behind the nichrome wire or it may even be tightly wrapped around the wire to improve its effectiveness. The purpose of the Teflon sheet is to prevent the freshly melted solder balls from collapsing back down onto themselves. If this were to happen, the nichrome wire would merely reform the pre-existing connections.

The application of nichrome to melt solder is similar to that used to melt plastic/Plexiglas in shop applications. Nichrome tends to increase in resistance as it heats, and a constant current power source is necessary to heat the wire to the desired melting point. It is possible to use a fixed (calibrated) source or one could permit an adjustment to allow altering the wire temperature. It may be desirable to be able to adjust temperature due to the fact that a number of different solder alloys are employed in BGA approaches, not simply eutectic Pb-Sn compositions.

The present invention is intended for rapid removal of BGAs. Since it is envisioned as a hand tool capable of being used in confined and remote locations. It is less expensive to produce and operate than other known option, i.e., hot air. An illustration of the desired removal process is shown in FIG. 5. This sequence clearly shows that the nichrome wire first melts solder balls and the Teflon sheet serves as a divider to keep the solder from collapsing back upon itself, as it would normally be inclined to do. The Teflon sheet also serves as a receptacle to hold and lift the BGA package away after all of the solder balls have been melted.

The only known alternative to the current invention involves using a hot air machine with hoses and appropriately shaped nozzles to guide air that is pre-heated to solder melting temperatures underneath the package. When the hot air is directed adequately with enough duration to melt the solder, it can then be removed with care. The present invention is far simpler in construction and use.

The present invention is analogous to a soldering iron, another hand tool for solder attachment and removal of electronics components. An alternate embodiment of the present invention might be based on a solder tip containing the tines and wire (stainless steel in this case) and a Teflon sheet.

What is claimed is:

1. A tool for removing a ball grid array (BGA) package containing an integrated circuit or a multi-chip module from a printed circuit board, said BGA package being attached to the printed circuit board by an array of solder balls, the tool comprised of:

a. a fork-shaped device having two tines, with each of said tines having an end and a base, the ends of said tines being separated and the bases of said tines converging to form a handle;

b. a wire stretched between the ends of said tines;

c. a sheet of insulation material filling an area enclosed by said tines, handle and wire; and d. means for heating said wire beyond the melting point of the solder balls.

2. The tool of claim 1, wherein said means for heating said wire consists of a constant current power supply and said wire is made of nichrome.

3. The tool of claim 1, wherein said sheet of material stretched between said tines is made of Teflon.

* * * * *